US007726945B2

(12) United States Patent
Grant et al.

(10) Patent No.: US 7,726,945 B2
(45) Date of Patent: Jun. 1, 2010

(54) INDUSTRIAL CEILING FAN

(75) Inventors: Donald P. Grant, Dubuque, IA (US); Paul Maly, Mequon, WI (US); John Moore, Marceline, MO (US); Ronald P. Snyder, Dubuque, IA (US); Aaron J. Wiegel, Benton, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 626 days.

(21) Appl. No.: 11/672,779

(22) Filed: Feb. 8, 2007

(65) Prior Publication Data

US 2008/0193294 A1 Aug. 14, 2008

(51) Int. Cl.

| | |
|---|---|
| ***F04D 25/08*** | (2006.01) |
| ***F04D 29/32*** | (2006.01) |
| ***F04D 29/34*** | (2006.01) |
| ***F04D 29/60*** | (2006.01) |
| ***F04D 29/64*** | (2006.01) |

(52) U.S. Cl. ..... 416/134 R; 416/210 R; 416/244 R; 416/246

(58) Field of Classification Search ..... 416/244 R, 416/246, 134 R, 131, 205, 140, 220 A
See application file for complete search history.

(56) References Cited

U.S. PATENT DOCUMENTS

| | | | |
|---|---|---|---|
| 399,973 | A | 3/1889 | Cassidy |
| 511,519 | A | 12/1893 | Fisher |
| 578,360 | A | 3/1897 | Phillips et al. |
| 681,710 | A | 9/1901 | Kemmerer |
| 921,744 | A | 5/1909 | Scott |

(Continued)

FOREIGN PATENT DOCUMENTS

| | | |
|---|---|---|
| AU | 0033624 | 9/2000 |

(Continued)

OTHER PUBLICATIONS

Patent Cooperation Treaty, "International Search Report", issued in connection with counterpart PCT application Serial No. PCT/US2008/052019, by the International Searching Authority, mailed Jun. 17, 2008 (7 pages).

(Continued)

*Primary Examiner*—Edward Look
*Assistant Examiner*—Jesse Prager
(74) *Attorney, Agent, or Firm*—Hanley, Flight & Zimmerman, LLC

(57) ABSTRACT

A large industrial ceiling fan includes exceptionally long fan blades with blade tips that can be tilted upward to more broadly distribute the air. Such broad distribution might be particularly beneficial in cases where the fan is installed relatively low to avoid obstacles such as hanging lights, sprinkler heads and rafters. A low mounting position is possible, because the fan is suspended from a hanger of adjustable length. The fan includes several joints that are redundantly bolted and welded for safety. A continuous retaining ring provides additional safety. A resilient bushing enhances the flexibility of the fan blades and reduces strain where the fan blades connect to a central mounting hub. To more broadly distribute the airflow underneath the fan, each fan blade has a twisted geometry to provide an angle of attack that decreases from the root to the tip of the blade.

15 Claims, 4 Drawing Sheets

U.S. PATENT DOCUMENTS

| | | | | |
|---|---|---|---|---|
| 1,501,201 | A | 7/1924 | Cates | |
| 1,642,205 | A | 9/1927 | Hosch | |
| 2,736,137 | A | 2/1956 | Thaheld | |
| 3,051,072 | A | 8/1962 | Bohanon | |
| 3,689,971 | A | 9/1972 | Davidson | |
| 3,768,546 | A | 10/1973 | Shipes | |
| 3,818,813 | A | 6/1974 | Freeman | |
| 4,008,007 | A | 2/1977 | Shipes | |
| 4,181,690 | A | 1/1980 | Neu | |
| 4,202,655 | A | 5/1980 | Maloof | |
| 4,263,842 | A | 4/1981 | Moore | |
| 4,275,993 | A | 6/1981 | Sprengling | |
| 4,373,241 | A | 2/1983 | Maloof | |
| 4,473,000 | A | 9/1984 | Perkins | |
| 4,522,255 | A | 6/1985 | Baker | |
| 4,640,668 | A | 2/1987 | Yang | |
| 4,730,551 | A | 3/1988 | Peludat | |
| 4,779,671 | A | 10/1988 | Dolison | |
| 4,822,246 | A | 4/1989 | Hsu | |
| 4,892,460 | A | 1/1990 | Volk | |
| 4,973,016 | A | 11/1990 | Hertenstein | |
| 5,078,574 | A | 1/1992 | Olsen | |
| 5,096,384 | A | 3/1992 | Immell et al. | |
| 5,246,343 | A | 9/1993 | Windsor et al. | |
| 5,328,329 | A | 7/1994 | Monroe | |
| 5,542,819 | A | 8/1996 | Bucher et al. | |
| 5,567,200 | A | 10/1996 | Swartzendruber | |
| 5,615,855 | A | 4/1997 | Marue et al. | |
| 5,709,458 | A | 1/1998 | Metz | |
| 5,795,220 | A | 8/1998 | Core | |
| 5,860,788 | A | 1/1999 | Sorensen | |
| 6,022,191 | A * | 2/2000 | Moore et al. | 416/134 R |
| 6,030,179 | A | 2/2000 | McCabe | |
| 6,039,533 | A | 3/2000 | McCabe | |
| 6,039,541 | A | 3/2000 | Parker et al. | |
| 6,244,821 | B1 * | 6/2001 | Boyd et al. | 416/210 R |
| 6,386,828 | B1 | 5/2002 | Davis et al. | |
| 6,443,702 | B1 | 9/2002 | Ross | |
| 6,589,016 | B2 | 7/2003 | Boyd et al. | |
| 6,644,928 | B1 | 11/2003 | Tang | |
| 6,692,229 | B2 | 2/2004 | Metz | |
| 6,719,532 | B2 | 4/2004 | Bird | |
| 6,719,533 | B2 | 4/2004 | Bird | |
| 6,733,241 | B2 | 5/2004 | Bird | |
| 6,812,849 | B1 | 11/2004 | Ancel | |
| 6,817,835 | B2 | 11/2004 | Boyd et al. | |
| 6,890,149 | B2 | 5/2005 | Metz et al. | |
| 6,939,108 | B2 | 9/2005 | Boyd | |
| D514,688 | S | 2/2006 | Avedon | |
| 2002/0001521 | A1 | 1/2002 | Boyd et al. | |
| 2002/0045420 | A1 | 4/2002 | Taillon | |
| 2002/0085919 | A1 | 7/2002 | Ross | |
| 2004/0084544 | A1 | 5/2004 | Boyd et al. | |
| 2004/0131470 | A1 | 7/2004 | Boyd | |
| 2004/0253112 | A1 | 12/2004 | Bird | |
| 2005/0202776 | A1 | 9/2005 | Avedon | |
| 2007/0134093 | A1 * | 6/2007 | Weiler | 416/60 |

FOREIGN PATENT DOCUMENTS

| | | |
|---|---|---|
| AU | 769503 | 9/2000 |
| AU | 4204417 | 7/2004 |
| BR | 0008199 | 1/2003 |
| BR | 0406637 | 12/2005 |
| CA | 2362648 | 8/2000 |
| CA | 2512550 | 7/2004 |
| CN | 1100239 C | 1/2003 |
| CN | 1723338 | 1/2006 |
| DE | 202005019872 | 7/2006 |
| EP | 1173359 | 1/2002 |
| EP | 1588024 | 10/2005 |
| JP | 2002537521 | 11/2002 |
| MX | PA01008285 | 9/2004 |
| WO | 99/60276 | 11/1999 |
| WO | WO0049342 | 8/2000 |
| WO | WO2004063571 | 7/2004 |

OTHER PUBLICATIONS

Patent Cooperation Treaty, "Written Opinion of the International Searching Authority", issued in connection with counterpart PCT application Serial No. PCT/US2008/052019, by the International Searching Authority, mailed Jun. 17, 2008 (7 pages).

International Bureau, "International Preliminary Report on Patentability," issued in connection with counterpart international application No. PCT/US2008/052019, issued Aug. 11, 2009, 7 pages.

Avedon Engineering, "Airius Thermal Equalizer Specification", Specification Sheet for Airius Thermal Equalizer; circa 2006, 7 pages.

Fairbank, W.C., et al. "A Large Paddle fan for Livestock Cooling": Paper No. 894083 from ASAE/CSAE meeting Presentation, Jun. 1989: 16 pages.

Bottcher, R.W., et al."Development of a Large Paddle Fan for Cooling Poultry": From Applied Engineering in Agriculture vol. 14(1): 87-96, Jan. 1998: 12 pages.

Flood, C.A. et al., "Energy Savings with Ceiling Fans in Broiler Houses": from Applied Engineering in Agriculture vol. 14(3), 305-309, May 1998, 7 pages.

Lin, J.C., et al."Comparison of Various Fan, Sprinkler, and Mister Systems in Reducing Heat Stress in Dairy Cows": from Applied Engineering in Agriculture vol. 14(2): 177-182, Mar. 1998: 8 pages.

Baughman, G.R. et al., "Field Evaluation of Large Paddle Fans in a Turkey Research Building": from 1998 ASAE Annual International Meeting, St. Joseph, MI, ASAE Paper No. 984043, Jul. 1998, 16 pages.

Bottcher, R.W., et al. "Vertically Directed Mixing Fans as an Alternative to Tunnel Ventiliation": from World Poultry—Misset, vol. 11 (3), 24-29, 1995, 8 pages.

Aynsley, R., "Fan Size and Energy Efficiency": from the International Journal of Ventilation, vol. 1(1), 33-38, Jun. 2002: 7 pages.

Armstrong, D.V., "Heat Stress Interaction with Shade and Cooling": from Journal of Dairy Science, vol. 77, 2044-2050, Jul. 1994, 9 pages.

Bray, D.R., et al., "Cooling Methods for Dairy Housing in the Souteastern United States": from ASAE paper No. 94-4501, Dec. 1994, 16 pages.

Igono, M.O., et al., "Physiological, Productive and Economic Benefits of Shade, Spray and Fan Systems vs. Shade for Holstein Cows During Summer Heat": from Journal of Dairy Science, vol. 70, 1069-1079, May 1987: 13 pages.

Strickland, J.T., et al., "Sprinkler and Fan Cooling for Dairy Cows in Hot, Humid Climates": from Applied Engineering in Agriculture, vol. 5(2), 231-326, Jun. 1989, 8 pages.

Turner, L.W., "Fan and High-Pressure Mist (Fog) Systems Performance for Cooling Lactating Dairy Cows": from Proceedings from 4$^{th}$ International Dairy Housing Conference in St. Joseph, MI, 201-208, Jan. 1998, 10 pages.

Timmons, M.B., et al., "Operational Characteristics of Overhead Fans": from Presentation at ASAE Winter 1983 Meeting, ASAE Paper No. 83-4512, Dec. 1983, 13 pages.

Blackwell, N.E., "Wall Jet Model for Ceiling Fan Applications in Broiler Houses": from Presentation at ASAE 1986 Winter Meeting, ASAE Paper No. 86-4538, Dec. 1986, 31 pages.

Armstrong, D., et al., "An Update on Cow Cooling Methods in the West": from Presentation at ASAE 1986 Summer Meeting, ASAE Paper No. 86-4034, Jun. 1986, 11 pages.

Aynsley, Richard, "Circulating Fan Velocity": from AMCA International InMotion, Oct. 2006: 3 pages.

Kammel, D.W., et al.,"Design of High Volume Low Speed Fan Supplemental Cooling System in Dairy Free Stall Barns": from ASABE Fifth International Dairy Housing Proceedings of Jan. 29-31, 2003 in Fort Worth, TX, Jan. 2003: 14 pages.

Abdul-Rahman, Dr. Abdul Malik, "Designing an Energy Efficient Fan by Dimensional and Physical Design Parameters": from http://www.eco-web.com, Jan. 2006, 7 pages.
"High vol. Low Speed Fans", from http://www.wisconsinpublicservice.com, EESFR-FS-1003A-G05, Oct. 2005: 4 pages.
House, Harold, "Large Ceiling Fans Offer Energy-Saving Way to Reduce Heat Stress": from The Ontario Milk Producer, Dec. 2003: 5 pages.
Kammel, David W., Article "HVLS Fans for Free Stall Barns": from Minnesota/Wisconsin Engineering Notes, Aug. 2001, 4-5, 10 pages.
Wortmann, F.X., "On the Optimization of Airfoils with Flaps", *Soaring*, May 1970; 12 pages.
Job Packet—Evidencing offer and sale of MooreFlo Fan from The Moore Company to Planet Fitness; original quote dated Dec. 3, 1997; order shipped Mar./Apr. 1998; includes advertising brochure of product; 25 pages.
Prosecution History, U.S. Appl. No. 6244821, 150 pages.
Prosecution History, U.S. Appl. No. 6589016, 143 pages.
Prosecution History, U.S. Appl. No. 6817835, 11 pages.
Prosecution History, U.S. Appl. No. 6939108, 23 pages.
Moore Fans Home p., archive dated Jul. 1998, retrieved from http://web.archive.org/web/19980702082925/http://www.moorefans.com on May 20, 2007, 1 page.
Tech Notes Index, Moore Fans, archive dated Jul. 1998, retrieved from http://web.archive.org/web/19980702083004/www.moorefans.com/techindx.htm on May 20, 2007, 1 page.
"How to Recognize a High Efficiency Fan," Moore Fans, archive dated Jul. 1998, retrieved from http://web.archive.org/web/19980702083142/www.moorefans.com/notes1.htm on May 20, 2007, 1 page.
"Two Hubs are Better than One!" Moore Fans, archive dated Jul. 1998, retrieved from http://web.archive.org/web/19980702083148/www.moorefans.com/notes2.htm on May 20, 2007, 2 pages.
"Methods for Modulating Airflow" Moore Fans, archive dated Jul. 1998, retrieved from http://web.archive.org/web/19980702083154/www.moorefans.com/notes3.htm on May 20, 2007, 1 page.
"Moore for the Asking" Moore Fans, archive dated Jul. 1998, retrieved from http://web.archive.org/web/19980702083017/www.moorefans.com/moorefor.htm on May 20, 2007, 1 page.
"How to Select a Low Noise Fan" Moore Fans, archive dated Jul. 1998, retrieved from http://web.archive.org/web/19980702083201/www.moorefans.com/notes4.htm on May 20, 2007, 2 pages.
"The Advantages of Pivoted 'Helicopter' Blades" Moore Fans, archive dated Jul. 1998, retrieved from http://web.archive.org/web/19980702083208/www.moorefans.com/notes5.htm on May 20, 2007, 2 pages.
"Cooler Upgrading: A Timely Topic" Moore Fans, archive dated Jul. 1998, retrieved from http://web.archive.org/web/19980702083215/www.moorefans.com/notes6.htm on May 20, 2007, 2 pages.
"Mooreflow Industrial Ceiling Fans" Moore Fans, archive dated Jul. 1998, retrieved from http://web.archive.org/web/19980702083114/www.moorefans.com/prod04.htm on May 20, 2007, 2 pages.
Table of Contents Frame in Frameset 1, Moore Fans, archive dated Jul. 1998, retrieved from http://web.archive.org/web/19980702082931/www.moorefans.com/frconten.htm on May 20, 2007, 1 page.

* cited by examiner

INDUSTRIAL CEILING FAN

FIELD OF THE DISCLOSURE

The present disclosure generally pertains to ceiling fans and more specifically to industrial ceiling fans.

BACKGROUND OF RELATED ART

It can be difficult to effectively ventilate large, wide-open areas of a building such as those areas typically found in warehouses and factories. Ductwork can be expensive and impractical in some applications, so as a low-cost alternative, a number of ceiling fans might be installed simply to keep the indoor air circulating.

An area can be ventilated by a large number of small fans or a fewer number of large fans. Either option has its advantages and disadvantages. Smaller fans can be easier to install between rafters, sprinkler heads, hanging lights and other obstacles found in some buildings. Small fans might also be strategically located to focus the ventilation where it is most needed. In buildings with high ceilings, however, small fans might not have the capacity to discharge air at a volume that can effectively reach the area near the floor where the occupants could appreciate the airflow, thus small fans might be almost worthless in some cases.

Larger fans might be able to discharge air at a volume and velocity that can reach the floor, however, large fans require more radial clearance, thus they can be more difficult to install between obstacles. If a large fan is lowered so that the fan blades rotate underneath the obstacles, the fan might be so low that it creates a focused draft directly below the fan rather than broadly distributing the air. Increasing the speed of the fan can worsen the focused draft problem. Decreasing the fan speed can eliminate the draft, but operating below the fan's rated speed can be an inefficient use of the fan. In addition, large fans are inherently heavier and may require creative means for ensuring that the fan and its various parts remain intact.

Consequently, a need exists for an industrial ceiling fan that overcomes the aforementioned drawbacks of both small and large fans.

SUMMARY

In some examples a ceiling fan is suspended from an adjustable length bar.

In some examples, a ceiling fan has a redundant combination of weld fillets and mechanical fasteners that helps ensure that the motor remains coupled to the hanger.

In some examples, the fan includes a safety ring that inhibits complete separation of the fan hub from the drive shaft and which serves to couple the blade support arms together.

In some examples, a ceiling fan has blade tips that are tilted upward.

In some examples, a resilient bushing helps couple the fan blades to the hub, wherein the bushing helps minimizes stress at the root of the fan blades.

In some examples, the resilient bushing allows the blades to deflect upward as the speed of the fan increases.

In some examples, the fan provides an airflow thrust with a reaction force that supports most of the blades weight.

In some examples, the fan blades are at least five feet long.

In some examples, the number of fan blades is no more than six, and the blades are relatively light compared to the thrust they exert.

In some examples, the fan blades are tapered and twisted along their length, and the blades angle of attack is greater near the root of the fan blade than near its tip to more evenly distribute the airflow across the full diameter of the fan.

DETAILED DESCRIPTION

Figure 1:
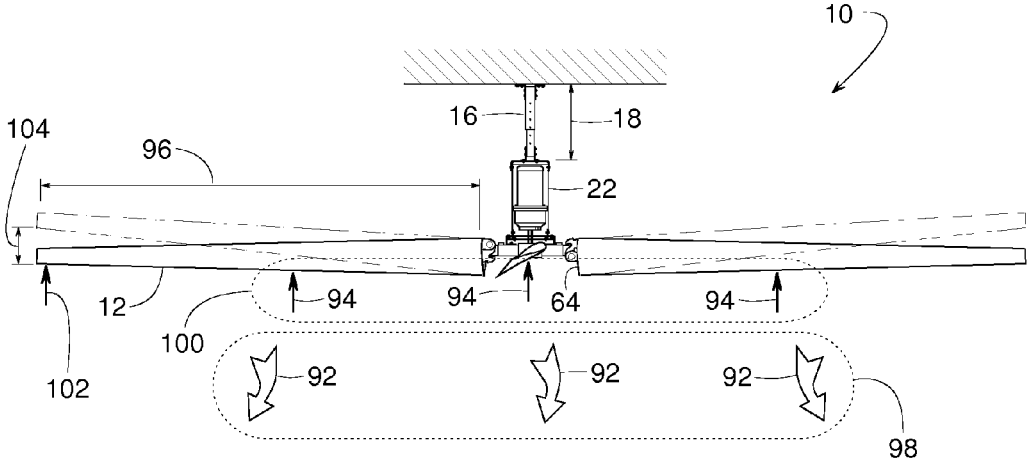
FIG. 1 is a side view of a ceiling fan with its blades when stationary being substantially horizontal.
Figure 2:
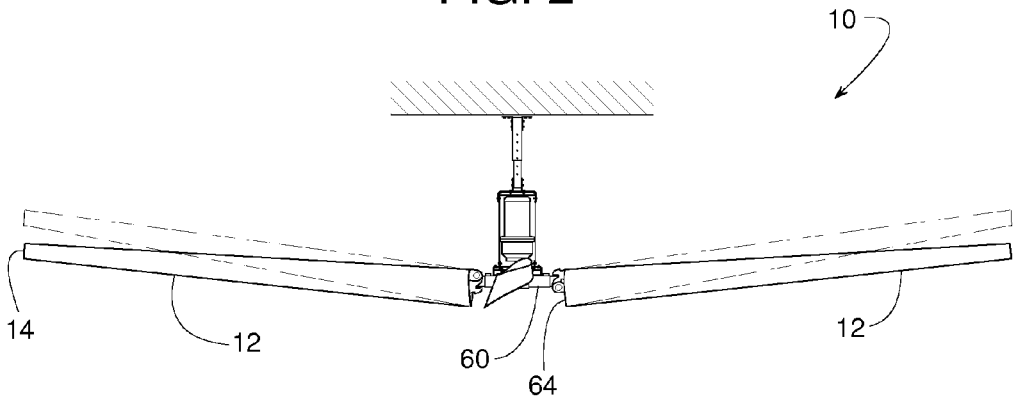
FIG. 2 is a side view of the ceiling fan of FIG. 1 but with the tip of the fan blades being tilted upward.
Figure 3:
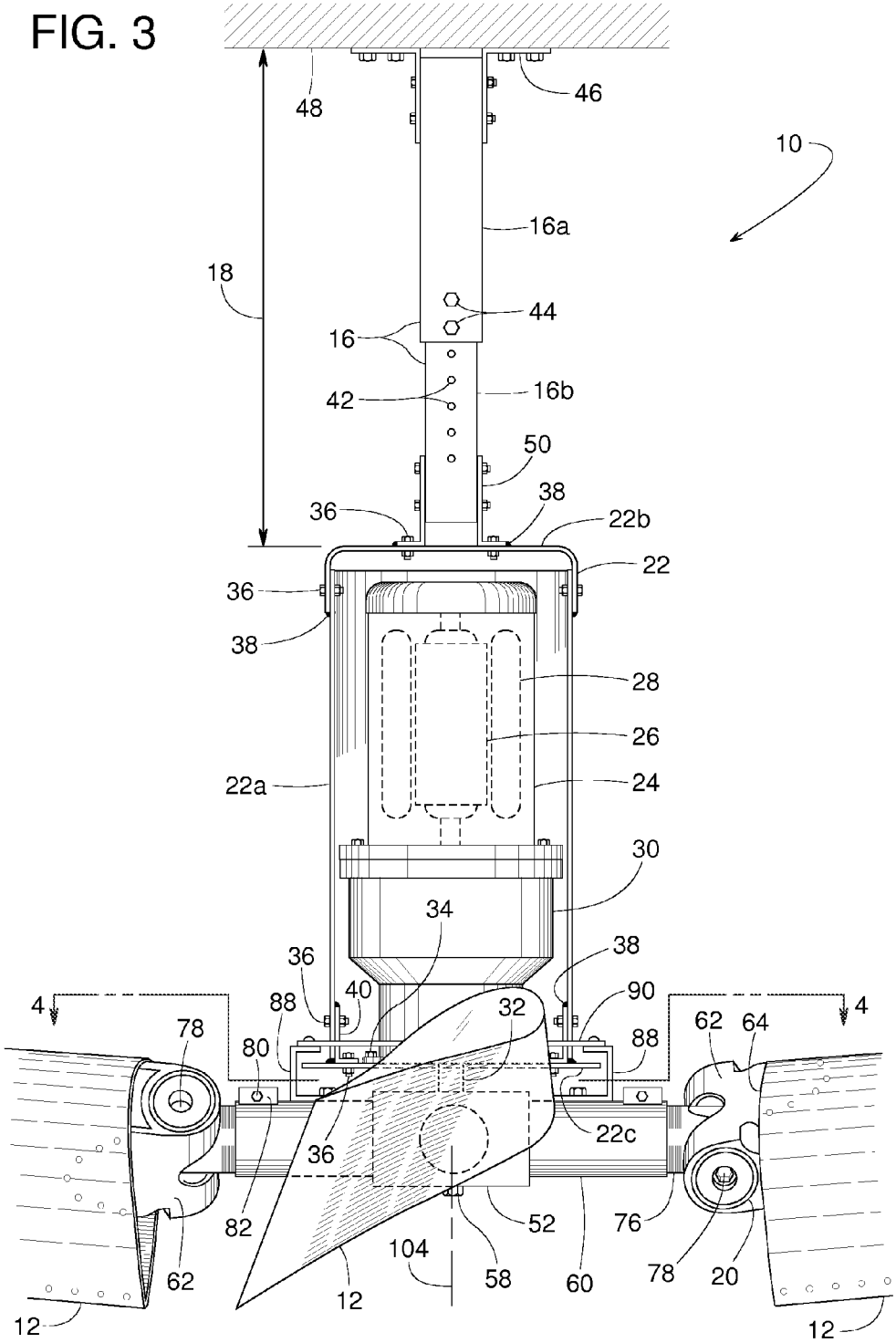
FIG. 3 is a closer side view of the fan of FIG. 2.
Figure 4:
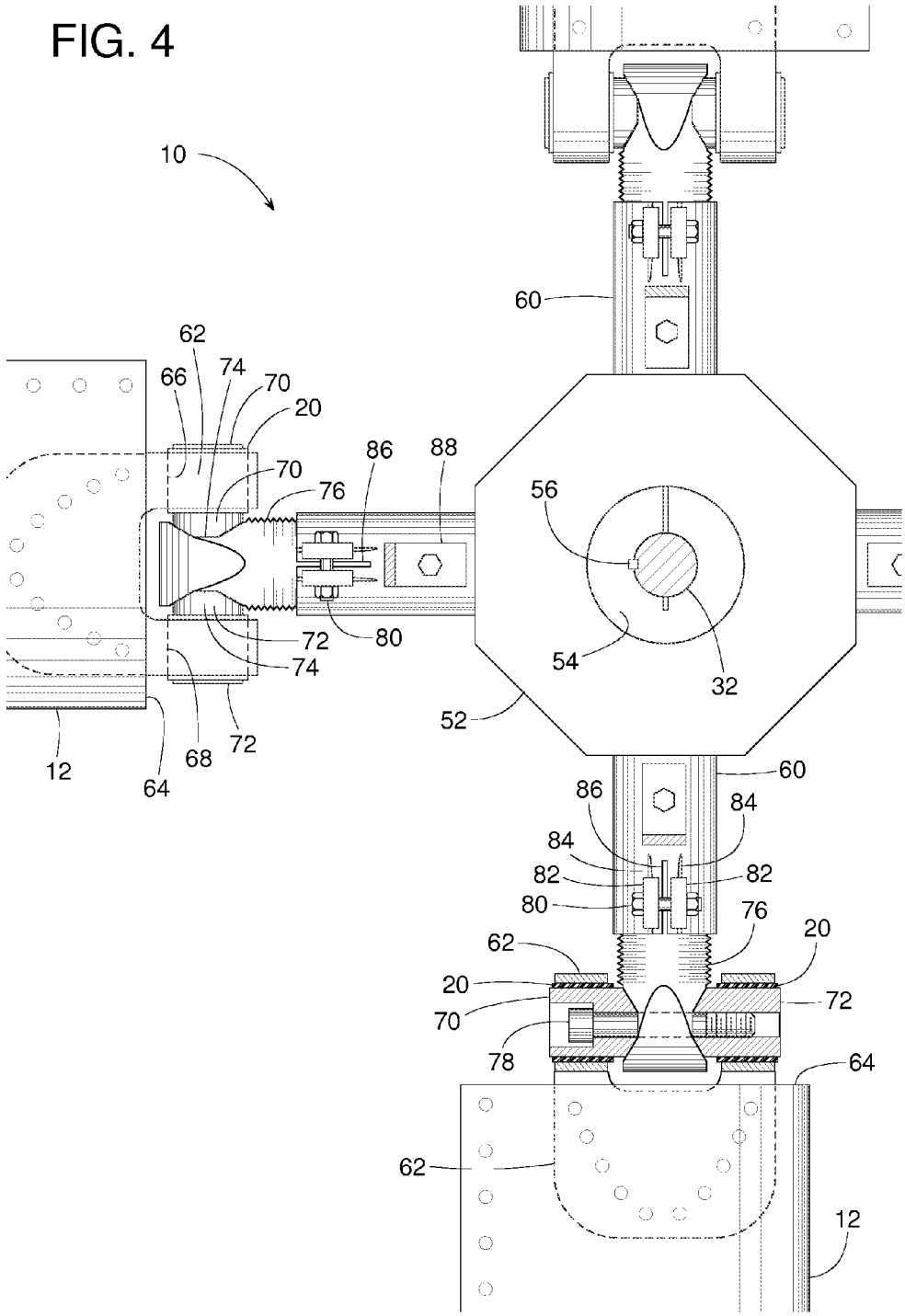
FIG. 4 is a cross-sectional view taken along line 4-4 of FIG. 3.
Figure 5:
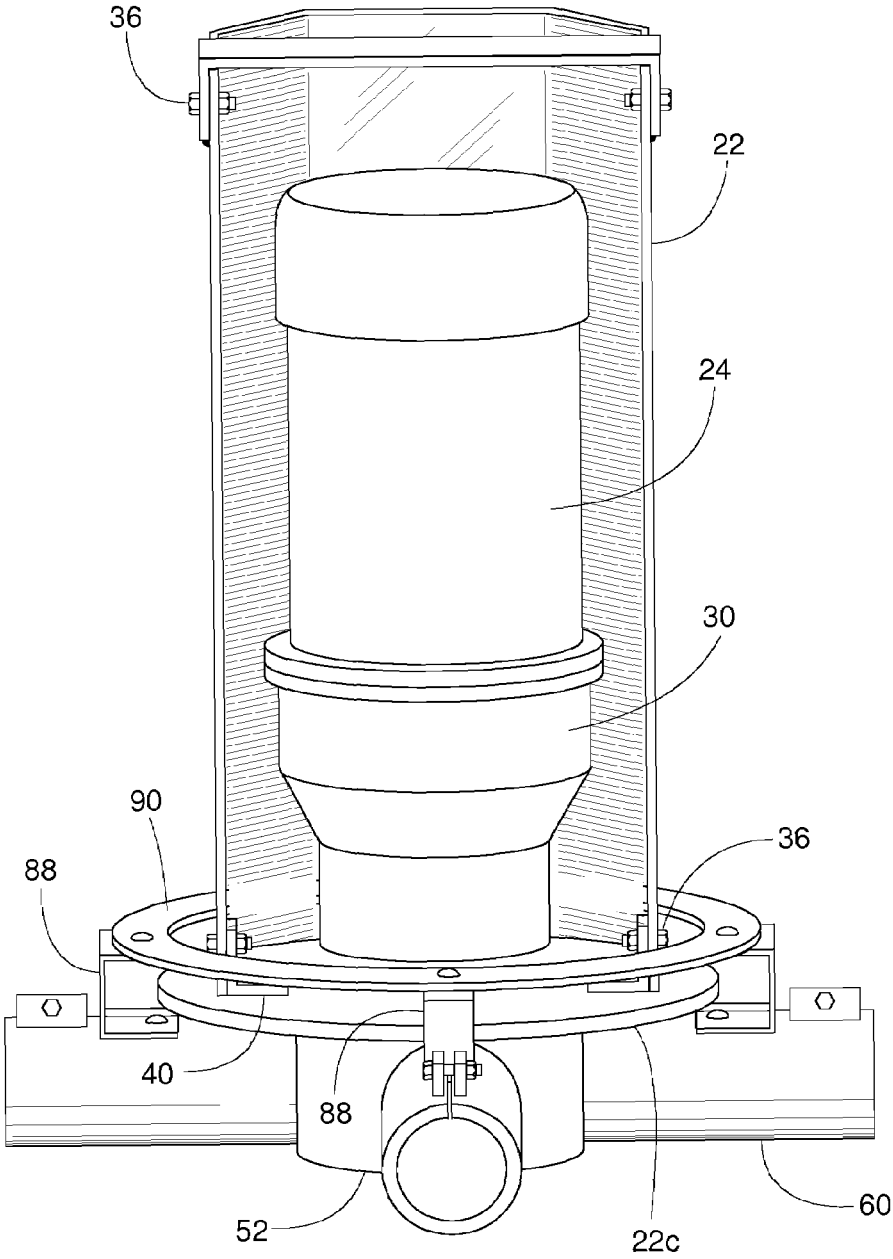
FIG. 5 is a perspective view of the ceiling fan but with the fan blades omitted.

A ceiling fan 10, illustrated in FIGS. 1-5, includes various features that make fan 10 particularly suited for ventilating large open areas in a building such as in a factory or warehouse. Fan 10, for instance, has fan blades 12 that can be five to twelve feet long (or longer) to ventilate a broad area below the fan 10; fan blades 12 can be tilted lengthwise with a blade tip 14 raised so that fan 10 can cover an even broader area; each fan blade 12 has a shape that varies along its length to promote airflow underneath the full diameter of the fan 10; a hanger 16 has an adjustable length 18 so that fan 10 can be installed at an elevation where fan blades 12 can avoid pipes, hanging light fixtures, overhead beams and various other obstacles often found in industrial buildings; a resilient connector 20 (FIGS. 3 and 4) provides fan blades 12 with strain relief and additional flexibility; and fan 10 includes a bracket assembly 22 with redundant or backup connections for safety.

To rotate fan blades 12, fan 10 includes an electric motor 24 comprising a rotor 26, a stator 28, and a speed-reducing gearbox 30. To keep the physical size and weight of motor 24 to a minimum (e.g., approximately 98 lbs) while providing sufficient horsepower (e.g., about 2 hp), rotor 26 rotates at a relatively high speed. To achieve an appropriate speed and torque for fan blades 12, gearbox 30 is coupled to rotor 26. Extending downward from gearbox 30 is an output drive shaft 32 that rotates at some predetermined rated speed (e.g., 50 rpm), which is considerably less than the speed of rotor 26. A variable speed drive can be used to vary the speed of rotor 26 and thus vary the speed of the fan blades.

Bolts 34 can be used to mount motor 24 to bracket assembly 22, which in turn can be connected to hanger 16. In an example, bracket assembly 22 includes a side plate 22*a* that is redundantly bolted (bolts 36) and welded (some type of fillet 38 welded or otherwise) to an upper plate 22*b* and a lower plate 22*c*. Side plate 22*a* is formed and/or fabricated to extend about halfway around the circumference of motor 24. Such a shape provides bracket 22 with adequate torsional stiffness and exposes motor 24 to ambient air for cooling the motor. Lower plate 22*c* is a round disc with a central hole through which drive shaft 32 protrudes and freely rotates within. L-shaped brackets 40 can be used for connecting side plate 22*a* to lower plate 22*c*. Upper plate 22*b* is generally U-shaped and serves to connect bracket 22 to hanger 16.

To provide hanger 16 with adjustable length 18 and torsional resistance, hanger 16 can be comprised of two telescoping square tubes 16*a* and 16*b*. Tube 16*a* or 16*b* can include a series of holes 42 to which another set of holes in the other tube can selectively be aligned. Once a chosen set of holes are aligned to provide hanger 16 with a desired length, bolts 44 can be inserted into the holes to lock tubes 16*a* and 16*b* in place. Connectors 46 can couple hanger 16 to a suitable overhead structure 48 (e.g., ceiling, rafters, etc.), and connectors 50 can be used for fastening hanger 16 to bracket assembly 22.

Below bracket assembly 22, drive shaft 32 connects to a hub 52. The connection can be achieved using a taper-lock bushing 54 (FIG. 4), a shaft key 56, and/or a redundant safety bolt 58 (FIG. 3) at the end of shaft 32. The threads on the safety bolt 58 should be chosen so as to ensure the safety bolt 58 tends to tighten under the normal operating direction of the fan 10. Hub 52 includes a plurality of fan blade support arms 60. For the illustrated example, hub 52 includes four arms 60 for four fan blades 12. Although more or less arms and fan blades are certainly possible, the quantity of four has been shown to provide a particularly desirable combination of cumulative blade weight, air thrust and balance, which will be explained later.

To connect fan blades 12 to hub 52, a yoke 62 is mounted to and extends from a root 64 of each fan blade 12. Yoke 62 defines two bores 66 and 68 into which two locking pins 70 and 72 are inserted. A resilient connector 20 in the form of a polymeric bushing (e.g., neoprene rubber) creates a radial interference fit that frictionally holds pins 70 and 72 within bores 66 and 68. Pins 70 and 72 matingly engage a neck 74 of an adjustable shank 76 that screws into support arm 60.

The distance to which shank 76 screws into arm 60 determines the radial position of fan blade 12 and thus provides a means for balancing fan 10. The rotation of shank 76 within arm 60 provides a means for adjusting a fan blade's pitch or angle of attack. The rotational position of pins 70 and 72 within bores 66 and 68 determines whether fan blade 12 is tilted up (FIG. 2) for broader distribution of air, tilted down (not shown) or level (FIG. 1).

Once fan blades 12 are properly adjusted, a screw 78 threadingly engages pin 72 to clamp pins 70 and 72 tightly against neck 74, and a second screw 80 tightens support arm 60 to shank 76. Tightening screw 80 draws together two tabs 82 that are locked into two flutes 84 on either side of an expansion slit 86 in arm 60. Thus, tightening screw 80 tends to close slit 86 so that arm 60 tightly constricts around the threads of shank 76, thereby locking shank 76 to arm 60. With pins 70 and 72 now fixed against rotation by virtue of engagement with neck 74, the resilient connector 20 allows for limited rotation of blade 12 about an axis generally defined by screw 78. With blade 12 at rest, the friction provided by connector 20 between pins 70 and 72 and bores 66 and 68 is adequate to support the weight of the blades without a mechanical hard stop. For fan rotation, the yieldability of the resilient connector 20 facilitates the tip of blade 12 rising as it forces air downwards, without placing undue stress on the hub assembly.

As an extra precaution against hub 52 accidentally separating from drive shaft 32, a series of brackets 88 fasten a retaining ring 90 (FIGS. 3 and 5) to fan blade support arms 60 that extend from hub 52. Retaining ring 90 completely encircles side plate 22*a* and is disposed above lower plate 22*c*. An inner diameter of ring 90 is smaller than the outer diameter of lower plate 22*c*, so lower plate 22*c* cannot fit through the inner diameter of ring 90. Consequently, if hub 52 were to descend relative to drive shaft 22, the descent would stop when ring 90 or brackets 88 encounters lower plate 22*c*. Upon engaging lower plate 22*c*, ring 90 being a continuous ring helps evenly distribute the weight of hub 52 and fan blades 12 among the series of ring-supporting brackets 88. In addition, ring 90 couples blade support arms 60 together, thus providing another redundant safety feature—should a support arm separate from the hub.

Additional notable features of fan 10 pertain to the fan's dynamic response during operation. The quantity, weight, and shape of fan blades 12 in conjunction with the fan blade's flexibility enhanced by resilient connector 20 causes the fan blade tips 14 to rise an appreciable amount in response to fan 10 forcing air downward. The rise of tips 14 is represented by the phantom lines of FIGS. 1 and 2. The phantom lines show the elevation of fan blades 12 while rotating at the rated speed, and the solid lines represents fan blades 12 while stationary. Although even horizontal fan blades 12 with their current shape (tapered and twisted from root 64 to tip 14) can broadly and thoroughly distribute discharge air over an indistinct flow pattern, a slight positive incline of fan blades 12 enhances this desirable effect by imparting a greater horizontal/radial component to the moved air as compared to an un-inclined blade.

In achieving this effect, each fan blade 12 preferably develops an individual airflow thrust 92 that creates an individual upward reaction force 94 that supports most of a single fan blade's weight. In some cases, reaction force 94 supports substantially all of the blade's weight. This is possible with the current fan blade's tapered hollow geometry, which provides a fan blade that weighs between only one and three pounds per foot of its length 96. Also, limiting the number of fan blades to six or less (such as, for example, four or three fan blades) means that a cumulative airflow thrust 98 (total thrust exerted by fan 10) creates a cumulative reaction force 100 that is distributed over fewer blades, thereby increasing the upward flexing of each individual blade during operation. The cumulative reaction force 100 provided by the blades, however, may be insufficient to place hanger 16 in compression, which might destabilize fan 10.

Although the invention is described with respect to various examples, modifications thereto will be apparent to those of ordinary skill in the art. The scope of the invention, therefore, is to be determined by reference to the following claims:

The invention claimed is:

1. A ceiling fan mountable to an overhead structure, the ceiling fan comprising:

a hanger mountable to the overhead structure;

a motor with a drive shaft that points generally downward;

a hub connected to the drive shaft such that the hub is below the motor;

a plurality of fan blades coupled to the hub;

a bracket assembly that couples the motor to the hanger;

a lower plate extending from the bracket assembly such that the lower plate is above the hub;

a retaining ring supported by the hub and disposed above the lower plate such that the lower plate and the retaining ring limit relative vertical movement between the hub and the bracket assembly if the hub were to descend relative to the drive shaft of the motor, and a plurality of brackets that couple the hub to the retaining ring.

2. The ceiling fan of claim 1, wherein the retaining ring encircles the motor.

3. The ceiling fan of claim 1, wherein the retaining ring encircles the drive shaft.

4. The ceiling fan of claim 1, wherein the plurality of brackets and the plurality of fan blades are in one-to-one correspondence.

5. The ceiling fan of claim 4, wherein the hub includes a plurality of arms to which the plurality of fan blades are connected, and the plurality of brackets are attached to the plurality of arms.

6. The ceiling fan of claim 5, wherein the plurality of arms, the plurality of brackets and the retaining ring are substantially fixed relative to each other.

7. The ceiling fan of claim 1, wherein the bracket assembly includes a redundant combination of fillets and mechanical fasteners that helps ensure that the motor remains coupled to the hanger.

8. The ceiling fan of claim 1, wherein the hanger comprises a pair of tubes that are telescopically engaged and have a generally rectangular cross-section, whereby the pair of tubes render the hanger vertically adjustable by virtue of the pair of tubes being telescopically engaged, and the hanger can resist torque by virtue of the pair of tubes having the generally rectangular cross-section.

9. The ceiling fan of claim 1, further comprising a plurality of resilient members that help resiliently couple the plurality of fan blades to the hub such that the plurality of fan blades can deflect both upward and downward more readily than if the plurality of fan blades were more rigidly coupled to the hub.

10. A ceiling fan mountable to an overhead structure, the ceiling fan comprising:

a hanger mountable to the overhead structure;

a motor with a drive shaft that points generally downward;

a hub connected to the drive shaft such that the hub is below the motor;

a plurality of arms extending from the hub;

a plurality of fan blades coupled to the plurality of arms;

a plurality of brackets connected to the plurality of arms;

a bracket assembly that couples the motor to the hanger;

a lower plate extending from the bracket assembly such that the lower plate is above the hub; and a retaining ring connected to the plurality of brackets and disposed above the lower plate such that the retaining ring encircles at least one of the motor and the drive shaft, wherein the lower plate and the retaining ring limit relative vertical movement between the hub and the bracket assembly if the hub were to descend relative to the drive shaft of the motor.

11. The ceiling fan of claim 10, wherein the plurality of arms, the plurality of brackets and the retaining ring are substantially fixed relative to each other.

12. The ceiling fan of claim 10, wherein the plurality of brackets and the plurality of fan blades are in one-to-one correspondence.

13. The ceiling fan of claim 10, wherein the bracket assembly includes a redundant combination of fillets and mechanical fasteners that helps ensure that the motor remains coupled to the hanger.

14. The ceiling fan of claim 10, wherein the hanger comprises a pair of tubes that are telescopically engaged and have a generally rectangular cross-section, whereby the pair of tubes render the hanger vertically adjustable by virtue of the pair of tubes being telescopically engaged, and the hanger can resist torque by virtue of the pair of tubes having the generally rectangular cross-section.

15. The ceiling fan of claim 10, further comprising a plurality of resilient members that help resiliently couple the plurality of fan blades to the plurality of arms such that the plurality of fan blades can deflect both upward and downward more readily than if the plurality of fan blades were more rigidly coupled to the plurality of arms.

* * * * *